US005696062A

United States Patent [19]

Delfort et al.

[11] Patent Number: 5,696,062

[45] Date of Patent: Dec. 9, 1997

[54] COLLOIDAL PRODUCTS CONTAINING CALCIUM BARIUM AND/OR MAGNESIUM ALSO BISMUTH MODIFIED BY THE ACTION OF CARBOXYLIC ACIDS CONTAINING SULPHUR AND OPTIONALLY NITROGEN

[75] Inventors: Bruno Delfort, Paris; Maurice Born, Nanterre; Bertrand Daoudal, Pontigny; Jacques Lallement, Aubervilliers, all of France

[73] Assignee: Institut Francais Du Petrole, Rueil-Malmaison, France

[21] Appl. No.: 750,003

[22] PCT Filed: Mar. 27, 1995

[86] PCT No.: PCT/FR95/00382

§ 371 Date: Feb. 7, 1997

§ 102(e) Date: Feb. 7, 1997

[87] PCT Pub. No.: WO96/30467

PCT Pub. Date: Oct. 3, 1996

[51] Int. Cl.[6] ..... C10M 159/20; C10M 159/24

[52] U.S. Cl. ..... 508/274; 508/460; 508/516

[58] Field of Search ..... 508/401, 460, 508/273, 516, 274

[56] References Cited

U.S. PATENT DOCUMENTS

| | | | |
|---|---|---|---|
| 3,929,650 | 12/1975 | King et al. | 508/460 |
| 4,198,317 | 4/1980 | Bertus et al. | 508/460 |
| 4,468,339 | 8/1984 | Rysek et al. | 508/460 |
| 5,536,424 | 7/1996 | Delfort et al. | 508/418 |

FOREIGN PATENT DOCUMENTS

| | | |
|---|---|---|
| 0 390 664 | 10/1990 | European Pat. Off. . |
| 0 536 020 | 4/1993 | European Pat. Off. . |
| 0 562 912 | 9/1993 | European Pat. Off. . |
| 0 598 646 | 5/1994 | European Pat. Off. . |
| 0 639 634 | 2/1995 | European Pat. Off. . |
| 2 716 891 | 9/1995 | France . |
| 997 335 | 7/1965 | United Kingdom . |

*Primary Examiner*—Jacqueline V. Howard

*Attorney, Agent, or Firm*—Millen, White, Zelano & Branigan, P.C.

[57] ABSTRACT

Colloidal products are obtained by a process which comprises at least partial neutralization of an overbased colloidal bismuth sulphonate type product containing a basicity reserve in the form of micellized calcium, barium or magnesium carbonate, using at least one carboxylic acid containing sulphur and optionally containing nitrogen. These products can be used as antiwear and extreme-pressure additives in lubricating oils and greases.

12 Claims, No Drawings

COLLOIDAL PRODUCTS CONTAINING CALCIUM BARIUM AND/OR MAGNESIUM ALSO BISMUTH MODIFIED BY THE ACTION OF CARBOXYLIC ACIDS CONTAINING SULPHUR AND OPTIONALLY NITROGEN

FIELD OF THE INVENTION

The present invention concerns colloidal products containing calcium and/or magnesium, also bismuth, modified by the action of acids containing sulphur and, optionally, nitrogen.

BACKGROUND OF THE INVENTION

In the French patent application entitled "Novel sulphonated compounds of bismuth, their preparation and use, in particular the preparation of overbased colloidal products which can be used as lubricant additives" deposited on the same day, the applicant described overbased colloidal products containing bismuth, which are compatible with hydrocarbon oils and can be used as additives with an antiwear and extreme-pressure action in lubricants. Those overbased colloidal products containing bismuth are obtained by carbonation of at least one calcium, barium or magnesium oxide or hydroxide, the calcium, barium or magnesium carbonate being maintained in a colloidal dispersion in the form of micelles in an organic medium by at least one sulphonated bismuth compound with one of the following general formulae:

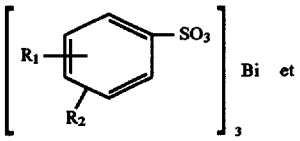

I

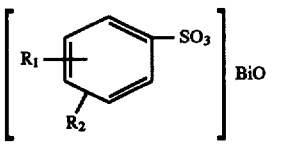

II the preparation of which is described in the same French patent application.

The overbased colloidal products of the present parallel application can be used as antiwear and extreme-pressure additives in mineral or synthetic lubricating oils and in greases.

SUMMARY OF THE INVENTION

We have now discovered that it is possible to modify these products to increase their sulphur content by partial or complete neutralization of their basicity reserve using at least one acid containing sulphur and, optionally, nitrogen, neutralization not affecting the colloidal nature of the products formed.

The colloidal products of the present invention can be defined in general as being produced by a process which comprises at least partial neutralisation of the basicity reserve of an overbased colloidal product comprising calcium, barium or magnesium carbonate dispersed in micellar form in an organic medium by at least one sulphonated bismuth compound with one of the following general formulae:

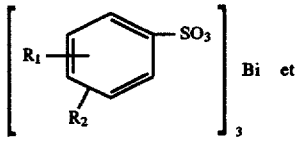

I

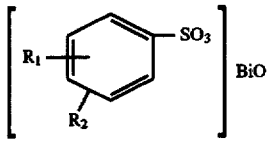

II where $R^1$ represents a linear or branched monovalent aliphatic hydrocarbon radical containing 8 to 36 carbon atoms and $R^2$ represents a hydrogen atom or a linear or branched monovalent aliphatic hydrocarbon radical containing 8 to 36 carbon atoms, said at least partial neutralization being carried out by means of at least one carboxylic acid containing sulphur or at least one carboxylic acid containing sulphur and nitrogen.

The overbased colloidal starting products generally have a basicity reserve in the form of calcium, barium or magnesium carbonate represented by a TBN (total base number) of up to about 550 mg of potassium/g of product (i.e., up to about 10 basic meq/g).

More particularly, the invention includes sulphur-containing carboxylic acids which are termed "short sulphur-containing carboxylic acids", having the general formula:

$$X—R^3—S_x—R^5—S_y—R^4—COOH \quad (III)$$

where $R^3$ and $R^4$ each represent a divalent hydrocarbon radical, for example an alkylene radical containing 1 to 6 carbon atoms; or a phenylidene radical, $R^5$ represents a single bond or a divalent hydrocarbon radical, for example an alkylene radical containing 1 to 4 carbon atoms, X represents a hydrogen atom or a carboxylic group; x and y each have an average value of 1 to 4 when $R^5$ is a divalent hydrocarbon radical and the sum (x+y) has an average value of 1 to 4 when $R^5$ represents a single bond.

More particularly, when $R^5$ is a single bond and X represents COOH, the sulphur-containing carboxylic acids have the following form:

$$HOOC—R^3—S_{(x+y)}—R^4—COOH$$

and examples are: thio-, dithio- trithio- and tetrathio-diglycolic, -dipropionic and -dibutyric acids, also 2,2'-dithiodibenzoic acid.

When $R^5$ is a divalent hydrocarbon radical and X is a carboxylic group, the acids are of the form:

$$HOOC—R3—S_x—R^5—S_y—R_4—COOH$$

and examples are: methylene- and ethylene-bis(thio-, dithio- and trithio-acetic) acids and methylene- and ethylene-bis (thio-, dithio- and trithio-propionic) acids.

Finally, when $R^5$ is a single bond and X is a hydrogen atom, the acids have the form:

$$HR^3—S_{(x+y)}—R^4—COOH$$

and examples are: ethyl thio-, dithio- and trithio-acetic, -propionic and -butyric acids.

Carboxylic acids of this type have already been described in our French patent FR-A-2 689 031.

Particular carboxylic acids containing sulphur and nitrogen which can be used in the process for the production of colloidal products of the invention are dicarboxylic acids with general formula:

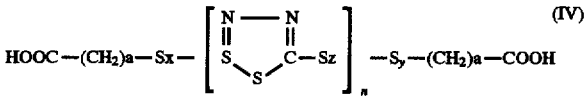

(IV)

where a each independently represents a whole number from 1 to 8, x and y each separately represents a number from 1 to 4, z represents a whole number from 0 to 4 and n takes the value 1 or 2.

More particularly, in formula (IV), each number a is 1 or 2, x and y are each 1 or 2 and z is zero or 1.

Examples of dicarboxylic acids with formula (IV) which can be used to prepare the colloidal products of the invention are:

3,3'-(1,3,4-thiadiazole-2,5-diyl)bis(3-thiapropanoic) acid;
4,4'-(1,3,4-thiadiazole-2,5-diyl)bis(4-thiabutanoic) acid;
4,4 '-(1,3,4-thiadiazole-2,5-diyl)bis(3,4-dithiabutanoic) acid;
5,5'-(1,3,4-thiadiazole-2,5-diyl)bis(4,5-dithiapentanoic) acid;
bis(3-(5-thio-1,3,4-thiadiazole-2-yl)-3-thiapropanoic) acid;
bis(4-(5-thio-1,3,4-thiadiazole-2-yl)-4-thiabutanoic) acid.

Carboxylic acids containing sulphur and nitrogen as defined above have already been described in our French patent application 93/10128, dated 18th Aug. 1993.

When at least partial neutralization is effected using at least one sulphur-containing carboxylic acid with general formula (III), the acid can be introduced in solution in water or in an organic solvent, such as tetrahydrofuran (THF), toluene or a xylene. It is added to the overbased colloidal product, which is itself dissolved in an organic solvent such as toluene, a xylene, hexane or tetrahydrofuran.

When at least one carboxylic acid containing sulphur and nitrogen with formula (IV) is used to effect neutralization, the reaction is generally carried out in an organic solvent which consists, in particular, of an aliphatic hydrocarbon (such as a hexane, heptane, octane or nonane), or a cycloaliphatic hydrocarbon (such as cyclohexane), an aromatic hydrocarbons (such as toluene or a xylene), optionally combined with tetrahydrofuran or methanol, used as co-solvents.

Reaction of the overbased colloidal product with a sulphur-containing carboxylic acid or with a sulphur- and nitrogen-containing carboxylic acid most probably leads to the formation of a calcium, barium or magnesium carboxylate. When a "short" sulphur-containing carboxylic acid as defined for the present invention is used, the isolated salt is generally completely insoluble in oils and hydrocarbons. Surprisingly, the action of "short" sulphur-containing carboxylic acids on overbased colloidal compounds produces products which are homogeneous, clear and stable over time, without precipitating out.

These unexpected characteristics lead to the thought that in the process for synthesising the products of the invention, sulphur-containing carboxylates, which are intrinsically insoluble in oils, are present inside micelles of the colloidal dispersion, as is the calcium, barium or magnesium oxide and/or hydroxide. Dialysis tests have confirmed this hypothesis.

In all cases, the colloidal nature of the products of the invention has been verified by dialysis through a latex membrane. Sulphur and, where appropriate, nitrogen analyses have localized these elements to the fraction which is not dialyzed (concentrate) which constitutes the colloidal portion of the product.

Neutralize of the basicity reserve of the overbased colloidal product can be partial or complete.

The proportion of sulphur-containing and optionally nitrogen-containing carboxylic acid is generally such that it can neutralize the overbased colloidal product by an amount which is up to about 50% of its total base number (TBN); normally, between 10% and 30% thereof.

When neutralization is partial, the overbased colloidal compound can be modified at the same time by reaction with other acids or other reactants, which can be used before or after using the sulphur-containing, and optionally nitrogen-containing, carboxylic acid, or simultaneously therewith.

The acids and additional reactants considered can, for example, be metaboric or orthoboric acid, or phosphoric and alkyl, -aryl- and/or alkylaryl-phosphoric acids.

The colloidal products obtained are stable, soluble in mineral and synthetic lubricants and are characterized by their sulphur content in the active material which can reach about 30% by weight, and optionally by their nitrogen content which can reach about 15% by weight.

The colloidal compounds containing sulphur and optionally nitrogen of the invention constitute excellent antiwear and extreme-pressure additives. Antiwear and extreme-pressure additives are incorporated into lubricants when the latter are intended to lubricate components which are subjected to large mechanical stresses, such as distribution in heat engines, gears, roll bearings and thrust bearings. Large mechanical stresses also occur during machining of metals, by cutting or by forming.

In addition, the colloidal compounds containing sulphur and, optionally, nitrogen, of the invention have good thermal stability which means that they can be used in lubricants which are used at very high temperatures which can reach 160° C., for example in some heavy engine housings, in highly loaded transmissions or during high speed metal cutting.

When using the products of the invention as additives for lubricating oils and greases, they can be incorporated into them at a concentration of 0.1% to 25% by weight, preferably 1% to 15% by weight, of active material, for example.

The lubricating oils (or greases) also generally contain one or more other additives such as additives which improve the viscosity index, additives which reduce the pour point, antioxidants, antirust agents, copper anticorrosion additives, detergents, antiwear agents, antifoaming agents, dispersing agents, or friction reducing agents, with which the products of the invention are compatible.

EXAMPLES

Examples A and B describe the preparation of two bismuth sulphonates corresponding to formulae (I) and (II).

Examples 1 and 2 describe the preparation of intermediate overbased colloidal products using the bismuth sulphonates prepared as described in Examples A and B. These examples do not in themselves form part of the invention.

Examples 3 to 6 illustrate the preparation of products in accordance with the invention, i.e., which have had their basicity reserve modified by a sulphur-containing acid or by an sulphur- and nitrogen-containing acid.

Examples 7 and 8 describe the tests carried out with the intermediate products of Examples 1 and 2 and the products of Examples 3 to 6 which are in accordance with the invention.

EXAMPLE A

Synthesis of a Bismuth Sulphonate 200 g of an alkylarylsulphonic acid with an average equivalent molar mass of 700 (i.e., 0.286 acid equivalents), 68 g of bismuth oxide $Bi_2O_3$, 400 $cm^3$ of xylene and 46 $cm^3$ of methanol were introduced into a reactor provided with a stirrer and a Dean and Stark separator. The medium was heated to the reflux temperature of xylene and kept at that temperature for 2 hours. After its return to ambient temperature, the medium was filtered and the filtrate was evaporated under reduced pressure. A homogeneous product containing 9.4% by weight of bismuth was obtained.

EXAMPLE B

Synthesis of a Bismuth Sulphonate 500 g of an alkylarylsulphonic acid with an average equivalent molar mass of 700 (i.e., 0.714 acid equivalents), 199 g of bismuth oxide $Bi_2O_3$, 800 $cm^3$ of xylene, 162 $cm^3$ of methanol and 30 g (1.67 mole) of water were introduced into a reactor provided with a stirrer and a Dean and Stark separator. The medium was heated to 70° C. for 2 hours then, after distillation of the methanol and water present in the medium, at the xylene reflux temperature, and kept at that temperature for 2 hours. After its return to ambient temperature, the medium was filtered and the filtrate was evaporated under reduced pressure. A homogeneous product containing 24.1% by weight of bismuth was obtained.

EXAMPLE 1

Synthesis of an Intermediate Overbased Colloidal Product 73.50 g of a bismuth alkylarylsulphonate prepared as described in Example A and containing 9.4% by weight of bismuth was introduced into a reactor provided with a stirrer, a means for introducing carbon dioxide and a thermometer, and dissolved in 219.9 g of a 130 Neutral mineral oil, 800 $cm^3$ of xylene, 30 $cm^3$ of methanol, 1.2 $cm^3$ of water and 2.7 $cm^3$ of ammonia. 67.80 g (0.916 mole) of time $Ca(OH)_2$ was dispersed in this solution and 32.3 g (0.733 mole) of gaseous carbon dioxide was bubbled through with vigorous stirring over 40 minutes at a temperature which did not exceed 45° C. After decanting and eliminating the upper hydroalcoholic phase, the lower phase was filtered followed by evaporating off the solvents under reduced pressure. A homogeneous liquid was obtained which had the following characteristics:

basicity reserve=3.46 basic meq/g, total base number (TBN)=194 mg KOH/g;

Bi=2.45% by weight;

Ca=7.50% by weight;

active material=39.2% by weight;

oil=60.8% by weight.

EXAMPLE 2

Synthesis of an Intermediate Overbased Colloidal Product 74.20 g of a bismuth alkylarylsulphonate prepared as described in Example B and containing 24.1% by weight of bismuth was introduced into a reactor provided with a stirrer, a means for introducing carbon dioxide and a thermometer, and dissolved in 166.9 g of a 130 Neutral mineral oil, 800 $cm^3$ of xylene, 30 $cm^3$ of methanol, 1.3 $cm^3$ of water and 2.6 $cm^3$ of ammonia. 34.3 g (0.464 mole) of lime $Ca(OH)_2$ was dispersed in this solution and 16.3 g (0.371 mole) of gaseous carbon dioxide was bubbled through with vigorous stirring over 40 minutes at a temperature which did not exceed 45° C. After decanting and eliminating the upper hydroalcoholic phase, the lower phase was filtered followed by evaporating off the solvents under reduced pressure. A homogeneous liquid was obtained which had the following characteristics:

basicity reserve=2.17 basic meq/g, total base number (TBN)=122 mg KOH/g;

Bi=7.95% by weight;

Ca=4.50% by weight;

active material=40.50% by weight;

oil=59.50% by weight.

EXAMPLE 3

Synthesis of a Product in Accordance with the Invention 80 g of the product prepared in Example 1, 80 g of a 130 Neutral mineral oil and 200 $cm^3$ of xylene were introduced into a reactor provided with a stirrer, a dropping funnel, a thermometer and a Dean and Stark separator. The medium was heated to a temperature in the range 70° C. to 90° C. then a solution of 2.51 g (0.0138 mole) of dithiodiglycolic acid in 30 $cm^3$ of tetrahydrofuran was introduced over one hour using the dropping funnel. After distilling off the tetrahydrofuran and the water of reaction, the medium was filtered then the xylene was evaporated off under reduced pressure. A homogeneous liquid product was obtained which had the following characteristics:

Bi=1.19% by weight;

Ca=3.60% by weight;

S=1.50% by weight;

active material=20.0% by weight.

EXAMPLE 4

Synthesis of a Product in Accordance with the Invention 80 g of the product prepared in Example 2, 40 g of a 130 Neutral mineral oil and 200 $cm^3$ of xylene were introduced into a reactor provided with a stirrer, a dropping funnel, a thermometer and a Dean and Stark separator. The medium was heated to a temperature in the range 70° C. to 90° C. then a solution of 1.57 g (0.0086 mole) of dithiodiglycolic acid in 30 $cm^3$ of tetrahydrofuran was introduced over one hour using the dropping funnel. After distilling off the tetrahydrofuran and the water of reaction, the medium was filtered then the xylene was evaporated off under reduced pressure. A homogeneous liquid product was obtained which had the following characteristics:

Bi=5.05% by weight;

Ca=3.10% by weight;

S=1.57% by weight;

active material=26.7% by weight.

EXAMPLE 5

Synthesis of a Product in Accordance with the Invention 60 g of the product prepared in Example 1, 60 g of a 130 Neutral mineral oil and 200 $cm^3$ of xylene were introduced into a reactor provided with a stirrer, a dropping funnel, a thermometer and a Dean and Stark separator. The temperature of the medium was raised to a temperature in the range 70° C. to 90° C. then a solution of 4.141 g (0.0156 mole) of 3,3'-(1,3,4-thiadiazole-2,5-diyl)bis(3-thiapropanoic) acid in 30 $cm^3$ of tetrahydrofuran was introduced over one hour using the dropping funnel. After distilling off the tetrahydrofuran and the water of reaction, the medium was filtered then the xylene was evaporated off under reduced pressure. A homogeneous liquid product was obtained which had the following characteristics:

Bi=1.17% by weight;

Ca=3.50% by weight;

S=2.30% by weight;

N=0.25% by weight;

active material=20.90% by weight.

EXAMPLE 6

Synthesis of a Product in Accordance with the Invention 60 g of the product prepared in Example 2, 60 g of a 130 Neutral mineral oil and 200 $cm^3$ of xylene were introduced into a reactor provided with a stirrer, a dropping funnel, a thermometer and a Dean and Stark separator. The temperature of the medium was raised to a temperature in the range 70° C. to 90° C. then a solution of 2.59 g (0.0098 mole) of 3,3'-(1,3,4-thiadiazole-2,5-diyl)bis(3-thiapropanoic) acid in 30 $cm^3$ of tetrahydrofuran was introduced over one hour using the dropping funnel. After distilling off the tetrahydrofuran and the water of reaction, the medium was filtered then the xylene was evaporated off under reduced pressure. A homogeneous liquid product was obtained which had the following characteristics:

Bi=3.80% by weight;

Ca=2.30% by weight;

S=1.85% by weight;

N=0.20% by weight;

active material=20.6% by weight.

EXAMPLE 7

Examination of Products by Dialysis in Heptane through a Latex Membrane

The intermediate products from Examples 1 and 2 and the products of the invention of Examples 3 to 6 were dialysed in solution in normal heptane through a latex membrane. For each test, the mass fraction which dialyzed (dialyzate) and that which did not dialyze (concentrate) were determined, the latter constituting the colloidal portion. In addition, the bismuth and/or sulphur and/or nitrogen content was also determined for each fraction. The results are shown in Table 1. Exclusive localization of the bismuth, sulphur and nitrogen in the concentrates confirmed the colloidal nature of the products.

TABLE 1

EXAMINATION OF PRODUCTS BY DIALYSIS

| Product from Example | Concentrate | | | | Dialysate | | | |
|---|---|---|---|---|---|---|---|---|
| No | % by wt | Bi % | S % | N % | % by wt | Bi % | S %* | N % |
| 1 | 39.2 | 6.1 | | | 60.8 | 0 | | |
| 2 | 40.5 | 19.9 | | | 59.5 | 0 | | |
| 3 | 20.0 | 6 | 6.9 | | 80.0 | 0 | 0.4 | |
| 4 | 26.7 | 18.7 | 5.5 | | 73.3 | 0 | 0.4 | |
| 5 | 20.9 | 5.4 | 10.6 | 1.2 | 79.1 | 0 | 0.4 | 0 |
| 6 | 20.6 | 18.3 | 8.3 | 0.9 | 79.4 | 0 | 0.4 | 0 |

*concentration of sulphur in the 130 Neutral oil used = 0.3/0.4% by weight.

EXAMPLE 8

Evaluation of Antiwear and Extreme-Pressure Properties

The antiwear and extreme-pressure properties of the intermediate products and products of the invention were evaluated in a 130 Neutral lubricating oil. The performances were evaluated using 4-ball machines using the ASTM D 2783 method. The results are shown in Table 2.

TABLE 2

EVALUATION OF ANTIWEAR AND EXTREME-PRESSURE PROPERTIES OF 7% OF ACTIVE MATERIAL IN 130 NEUTRAL OIL

| Product from Example | Weld load (daN) |
|---|---|
| none | 126 |
| 1 | 220 |
| 2 | 220 |
| 3 | 240 |
| 4 | 230 |
| 5 | 240 |
| 6 | 240 |

We claim:

1. A colloidal product containing calcium, barium and/or magnesium as well as bismuth, sulphur and, optionally, nitrogen, characterized in that it is obtained by a process which comprises at least partial neutralization of the basicity reserve of an overbased colloidal product comprising calcium, barium or magnesium carbonate dispersed in micellar form in an organic medium by at least one sulphonated bismuth compound with one of the following general formulae:

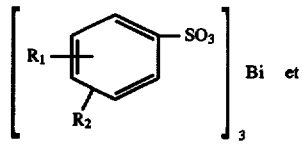

I

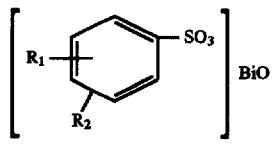

II where $R^1$ represents a linear or branched monovalent aliphatic hydrocarbon radical containing 8 to 36 carbon atoms and $R^2$ represents a hydrogen atom or a linear or branched monovalent aliphatic hydrocarbon radical containing 8 to 36 carbon atoms, said at least partial neutralization being carried out by means of at least one carboxylic acid containing sulphur or at least one carboxylic acid containing sulphur and nitrogen.

2. A colloidal product according to claim 1, characterized in that the overbased colloidal starting product has a basicity reserve of up to about 10 basic meq/g (TBN up to 550 mg KOH/g).

3. A colloidal product according to claim 1, characterized in that at least one sulphur-containing carboxylic acid termed a "short" carboxylic acid is used, which has general formula:

$$X—R^3—S_x—R^5—S_y—R^4—COOH \quad (III)$$

where $R^3$ and $R^4$ each represent a divalent hydrocarbons radical; $R^5$ represents a single bond or a divalent hydrocarbon radical; X represents a hydrogen atom or a carboxylic group; x and y each have an average value of 1 to 4 when $R^5$ is a divalent hydrocarbon radical and the sum (x+y) has an average value of 1 to 4 when $R^5$ represents a single bond.

4. A colloidal product according to claim 3, characterized in that said sulphur-containing carboxylic acid is selected from thio-, dithio- trithio- and tetrathio-diglycolic, -dipropionic and -dibutyric acids, 2,2'-dithiodibenzoic acid, methylene- and ethylene-bis(thio-, dithio- and trithio-acetic) acids, methylene- and ethylene-bis(thio-, dithio- and trithio-propionic) acids, and ethyl thio-, dithio- and trithio-acetic, -propionic and -butyric acids.

5. A colloidal product according to claim 3, characterized in that said sulphur-containing carboxylic acid is used in solution in water or in an organic solvent and said overbased colloidal product formed in step (a) is used in solution in a hydrocarbon solvent.

6. A colloidal product according to claim 1, characterized in that at least one sulphur-containing and nitrogen-containing carboxylic acid is used which the general formula:

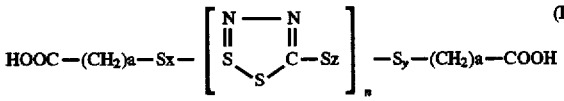

(IV)

where a each independently represents a whole number from 1 to 8, x and y each separately represents a number from 1 to 4, z represents a whole number from 0 to 4 and n takes the value 1 or 2.

7. A colloidal product according to claim 6, characterized in that said dicarboxylic acid is:

3,3'-(1,3,4-thiadiazole-2,5-diyl)bis(3-thiapropanoic) acid;

4,4'-(1,3,4-thiadiazole-2,5-diyl)bis(4-thiapropanoic) acid;

4,4'-(1,3,4-thiadiazole-2,5-diyl)bis(3,4-dithiabutanoic) acid;

5,5'-(1,3,4-thiadiazole-2,5-diyl)bis(4,5-dithiapentanoic) acid;

bis(3-(5-thio-1,3,4-thiadiazole-2-yl)-3-thiapropanoic) acid; or bis(4-(5-thio-1,3,4-thiadiazole-2-yl)-4-thiabutanoic) acid.

8. A colloidal product according to claim 6, characterized in that the reaction is carried out in an organic solvent selected from aliphatic hydrocarbons, cycloaliphatic hydrocarbons and aromatic hydrocarbons, optionally combined with tetrahydrofuran and methanol.

9. A colloidal product according to claim 1, characterized in that said sulphur-containing and, optionally, nitrogen-containing carboxylic acid is used in a proportion which can neutralize said overbased colloidal product to an amount which can be up to 50% of its total base number.

10. A colloidal product according to claim 1, characterized in that said carboxylic acid is combined with at least one other acid selected from metaboric and orthoboric acids, phosphoric acid and alkyl-, aryl- and alkylarylphosphoric acids.

11. A colloidal product according to claim 1, characterized in that it has a sulphur content of up to about 30% by weight and a nitrogen content of up to about 15% by weight, expressed with respect to the active material.

12. A lubricating oil or grease composition, characterized in that it comprises a major proportion of lubricating oil or grease and a proportion of active material of 0.1% to 25% by weight of at least one product according to claim 1.

* * * * *